US006813462B2

(12) United States Patent
Mitsuya et al.

(10) Patent No.: US 6,813,462 B2
(45) Date of Patent: Nov. 2, 2004

(54) ELECTRO-PHOTOGRAPHIC DEVELOPING UNIT

(75) Inventors: Teruaki Mitsuya, Ibaraki (JP); Tsuneaki Kawanishi, Ibaraki (JP); Masayoshi Ishii, Ibaraki (JP); Hisao Okada, Ibaraki (JP); Hiroyoshi Matsumoto, Ibaraki (JP); Keisuke Kubota, Ibaraki (JP); Natsuki Kuribayashi, Ibaraki (JP)

(73) Assignee: Hitachi Printing Solutions, Ltd., Ebina (JP)

( * ) Notice: Subject to any disclaimer, the term of this patent is extended or adjusted under 35 U.S.C. 154(b) by 0 days.

(21) Appl. No.: 10/351,533

(22) Filed: Jan. 27, 2003

(65) Prior Publication Data

US 2003/0143001 A1 Jul. 31, 2003

(30) Foreign Application Priority Data

Jan. 28, 2002 (JP) ..... P.2002-018211
Mar. 15, 2002 (JP) ..... P.2002-073338

(51) Int. Cl.[7] ..... G03G 15/09
(52) U.S. Cl. ..... 399/269
(58) Field of Search ..... 399/267, 269, 399/277, 275; 430/122

(56) References Cited

U.S. PATENT DOCUMENTS 4,266,868 A * 5/1981 Bresina et al. ..... 399/269

FOREIGN PATENT DOCUMENTS

JP 58-142358 8/1983

* cited by examiner

*Primary Examiner*—Robert Beatty
(74) *Attorney, Agent, or Firm*—McGinn & Gibb, PLLC

(57) ABSTRACT

A developing unit in an electro-photographic apparatus such as a printer, a facsimile and a copier for actualizing an image employing colored particles such as toner, and more particularly to a developing unit for forming a toner image on the surface of a photosensitive body. The developing unit includes a plurality of developing rollers each having a core and a sleeve. The sleeve accommodates the core. The plurality of developing rollers include a first developing roller and a second developing roller. The sleeve for the first developing roller is rotated to move in the same direction as a moving direction of the surface of the photosensitive body. The sleeve for the second developing roller is rotated to move in an opposite direction to the moving direction of the surface of the photosensitive body. The core of only one of the plurality of developing rollers is driven in rotation while the other core is fixed. Alternatively, a magnetic pole of one of the developing rollers is placed at an opposing position where the developing rollers mutually oppose while an intermediate portion between two poles of the second developer roller is placed at the opposing position.

19 Claims, 9 Drawing Sheets

ELECTRO-PHOTOGRAPHIC DEVELOPING UNIT

BACKGROUND OF THE INVENTION

1. Field of the Invention

The present invention relates to a developing unit and an electro-photographic apparatus such as a printer, a facsimile and a copier for actualizing an image employing colored particles such as toner, and more particularly to a developing unit and an electro-photographic apparatus having a feature in a developing process of forming a toner image on the surface of a photosensitive body.

2. Background Art

Conventionally, the printers of electro-photographic method have a developing process for actualizing an image on the surface of photosensitive body using colored particles, and a transfer process for transferring the actualized image of colored particles onto a recording medium. The colored particles may be a powder called a toner exclusively used for electrophotography.

The photosensitive body is evenly charged over its entire surface, and then partially discharged by radiating light. At this time, a potential contrast with a charged region and a discharged region is formed on the surface of photosensitive body to form an electrostatic latent image.

In the developing process, first of all, the toner particles are charged using a developer. The developer is classified into a two-component type consisting of a mixture powder of the toner and carrier beads as magnetic particles and a one-component type of the toner alone. The developer is received in the developing unit, and agitated.

Specifically, a two-component developer is composed of a mixture of the toner as colored particles of resin powder having a particle diameter of about 10 micrometers, and the carrier of magnetic particles having an average particle diameter of 30 to 100 micrometers such as ferrite, magnetite, or iron powder. A one-component developer contains a magnetic powder in the toner and not using the carrier.

In the two-component type developer, the toner is charged due to the friction with carrier beads. Also, in the developer of one-component type, the toner is charged due to the friction with members.

The developer is conveyed to a developing position opposed to an electrostatic latent image on the surface of photosensitive body by a magnet roller called a developing roller. At this time, a "magnetic brush" in which the developer is arranged like a brush along the magnetic force lines is formed in a region opposed to the photosensitive body.

In the manner, a developing method in which the developer is conveyed to the electrostatic latent image on the photosensitive body by the magnetic roller is called a magnetic brush development.

On one hand, a method for actualizing the electrostatic latent image, called a bias development, is often employed. In the bias development, a bias voltage is applied to the developing roller, and the charged toner particles are separated from the developer on the surface of the developing roller, owing to an electric field generated between a latent image potential on the surface of photosensitive body and the developing roller, and moved to the surface of photosensitive body, thereby performing the image formation.

The charging potential or discharging potential may be employed as the latent image potential, or a potential of an image forming portion of the photosensitive body.

Generally, the method of using the charging potential as the latent image potential is called a normal development, or the method of using the discharging potential is called a reversing development.

One of the charging potential and the discharging potential that is not used as the latent image potential is called a background potential. The bias voltage of the developing roller is set at a certain value between the charging potential and the discharging potential, and a difference from the latent image potential is called a developing potential difference.

Similarly, a difference from the background potential is called a background potential difference. Usually, the developing potential difference for governing a development performance itself is set to be greater than the background potential difference. With greater developing potential difference, the formed electric field (developing electric field) is increased, so that the development performance (toner developing amount) is enhanced.

Also, increasing the rotating speeds of the developing roller and the photosensitive body, reducing the distance, and decreasing the electrical resistance of the developer have effect on strengthening the developing electric field, making it possible to increase the toner developing amount.

A developing method of using the magnetic brush development to convey the developer, and the bias development to actualize the electrostatic latent image (hereinafter referred to as a "magnetic brush bias development") is widely employed.

A relative moving direction of the developing roller and the photosensitive body may be the same or opposite. Also, one developing unit may employ a plurality of developing rollers. In some developing unites, the plurality of developing rollers are rotated in the same direction, but in other developing unites, they are rotated in different directions.

In this case, a developing unit is well-known in which the adjacent developing rollers are rotated in different rotations from the opposite position of developing rollers toward the photosensitive body, and the developer is branched and conveyed like a fountain from the opposite position of developing rollers to the photosensitive body (hereinafter referred to as a "fountain-type developing unit").

The magnetic brush bias development has a problem that the image edge is difficult to develop in the rotation direction of the developing roller. This problem occurs due to a mechanical factor that the magnetic brush rubs against the surface of photosensitive body, and because the potential of the photosensitive body contacted by the magnetic brush is drastically changed from the background potential of non-image part to the developing potential of image part to change the electrical characteristics of the developer.

Thus, using the fountain-type developing unit, two developing rollers rotated in different directions compensate each other, thereby solving this problem.

The developing roller includes a core having the magnetic poles and a metallic sleeve containing this core, in which the developer is conveyed by rotating the sleeve with the core fixed (hereinafter referred to as a "sleeve rotating method") or rotating both the core and the sleeve (hereinafter referred to as a "core rotating method").

In addition, it is called a sleeve rotation developing roll in which the magnetic roll inside the developing roll is fixed. It is called a double rotation developing roll in which the internal magnet roll is also rotated.

The core rotation method is more effective in agitating the developer in a developing area opposed to the photosensitive body than the sleeve rotation method, and has a greater toner developing amount. Therefore, even if the rotating speed of the sleeve is decreased, a sufficient toner developing amount can be assured to reduce the scraped toner image on the photosensitive body caused by mechanical sliding of the developing roller itself, thereby improving the image quality.

The core rotating developing unit was described in JP-A-58-142358.

Further, a developing method using two double rotation developing rolls was described in JP-A-58-142358. As its contents, a first double rotation developing roll rotates the sleeve and the magnet roll in opposite directions, or rotates the sleeve alone, while a second double rotation developing roll rotates the sleeve and the magnet roll in the same direction.

SUMMARY OF THE INVENTION

When the fountain-type developing unit having the feature that no defective image edge is caused due to the electrical factor employs at least one of the developing rollers based on the core rotating method (hereinafter referred to as a "core rotating fountain-type developing unit"), the scraped toner image due to the mechanical factor can be reduced, whereby the very high quality image with less disorder can be produced.

However, the core rotating fountain-type developing unit has a problem that the image has jitter because two magnet rollers are rotated to cause vibration due to a magnetic field interference between the magnetic poles.

Also, in the two-component development, there is a problem that the magnetic force is temporally varied in strength in the developing area, and the carrier is likely to be attached onto the photosensitive body when the magnetic force is weak.

The temporal magnetic force changes in the developing area appear as "fogging" in the one-component development.

The present invention has been achieved in the light of the above-mentioned problems. It is a first object of the invention to provide a developing unit and an electrophotographic apparatus that can print the high quality image by preventing jitter, splashing of carrier, and fogging from occurring due to vibration.

Further, in the previous method using two double rotation developing rolls, since a rotating magnetic field or a fixed magnetic field generated by the magnet roll of the first roll and a rotating magnetic field generated by the second roll pass each other in opposite directions at the most proximate point of two developing rolls, a magnetic interference between the first roll and the second roll occurs, or the magnetic poles attract or repel each other, so that the developing unit itself is vibrated around the rotation axis of the double rotation developing roll. Vibration of the developing unit causes the jitter, resulting in nonconformity that the striped unevenness appears on the image. With this constitution, two developing rollers must be fully separated from each other to avoid vibration due to interference of magnetic poles, resulting in a problem that the developing machine is larger in size.

In order to solve this problem, it is a second object of the present invention to provide an electro-photographic printer that can print a high definition image in a developing unit having a developing roll composed of a sleeve and a magnet roll that are both rotated by reducing vibration due to an interference between one magnetic pole of a rotating magnetic roll and the other magnetic pole.

In order to attain the first object, the invention provides a developing unit for developing an electrostatic latent image formed on a photosensitive body by supplying colored particles to the surface of the photosensitive body, which includes a plurality of developing rollers each having a core and a sleeve. The sleeve accommodates the core. The plurality of developing rollers includes a first developing roller and a second developing roller. The sleeve for the first developing roller is rotated to move in the same direction as a moving direction of the surface of the photosensitive body. The sleeve for the second developing roller is rotated to move in an opposite direction to the moving direction of the surface of the photosensitive body. The core for at least one of the plurality of developing rollers is driven in rotation.

In the developing unit as above constituted, one core is driven in rotation, thereby solving the problem that two cores are separately driven in rotation to give rise to vibration due to magnetic field interference between the magnetic poles.

Preferably, rotation of the core for one of the plurality of developing rollers follows rotation of the core for another one of the plurality of developing rollers.

In the developing unit as above constituted, one core is driven in rotation, and another core is freely rotated by following the rotation of the one core, whereby a balance point with the least force applied due to magnetic field interference is automatically generated to prevent the periodical vibration from occurring.

Preferably, the core for one of the plurality of developing rollers is fixed.

In the developing unit as above constituted, the sleeve is rotated with the core for one developing unit fixed to make the sleeve rotating method, whereby the fixed magnetic poles exist in the developing area opposed to the photosensitive body to exert a strong magnetic force at any time. Therefore, the carrier is attracted and not splashed, and the toner is not splashed to cause fogging on the background portion.

Also, the rotating sleeve cleans the carrier attached onto the photosensitive body or the toner of fogging on the background portion.

Preferably, the core is fixed via a damper.

In the developing unit as above constituted, since the core for the developing roller is fixed, there is the fear that the vibration occurs due to magnetic field interference of the core for the opposed developing roller, but since the core is fixed via the damper, an abrupt change in the torque is prevented by absorbing the rotation of the fixed core along with the rotation of opposed core.

The invention provides a developing unit for developing an electrostatic latent image formed on a photosensitive body by supplying colored particles to a surface of the photosensitive body, which includes first and second developing rollers each having a core and a sleeve. The sleeve accommodates the core. The core has magnetic poles. The cores of the first and second developing rollers have the same arrangement of the magnetic poles. The magnetic pole of the core of one of the first and second developing rollers is placed at an opposing position where first and second developing rollers mutually oppose, while the core of the other one of the first and second developing rollers is disposed such that a intermediate portion between the magnetic poles thereof is placed at the opposing position. The sleeve of the first developing roller is driven to rotate in the same direction as a moving direction of the surface of the photosensitive body. The sleeve of the second developing roller is driven to rotate in an opposite direction to the moving direction of the surface of the photosensitive body.

In the developing unit as above constituted, one sleeve is rotated to move in the same direction as the moving direction of the surface of photosensitive body, and the other sleeve is rotated to move in the opposite direction to the moving direction of the surface of photosensitive body, whereby the colored particles can be supplied onto the photosensitive body from two directions, and surely attached to the edge portion of the latent image formed on the surface of photosensitive body.

In the rotation of two cores having the same arrangement of magnetic poles, the magnetic pole of one core is placed between the magnetic poles of the other core, so that a constant magnetic force is applied on both the developing rollers to prevent vibration from occurring.

The invention provides an electro-photographic apparatus, which includes a photosensitive body, a charger for charging a surface of the photosensitive body, an exposing unit for exposing the surface of the photosensitive body charged by the charger to form an electrostatic latent image having different potential levels of at least two values on the surface of the photosensitive body, a developing unit for forming a visible image on the photosensitive body by supplying colored particles to the surface of the photosensitive body; and a transfer unit for transferring the visible image onto a recording medium. The developing unit includes a plurality of developing rollers each having a core and a sleeve. The sleeve accommodates the core. The plurality of developing rollers includes a first developing roller and a second developing roller. The sleeve for the first developing roller is rotated to move in the same direction as a moving direction of the surface of the photosensitive body. The sleeve for the second developing roller is rotated to move in an opposite direction to the moving direction of the surface of the photosensitive body. The core for at least one of the plurality of developing rollers is driven in rotation.

In the electro-photographic apparatus as above constituted, the sleeve for at least one developing roller is rotated to move in the same direction as the moving direction of the surface of photosensitive body, and the sleeve for at least one of the other developing rollers is rotated to move in the opposite direction to the moving direction of the surface of the photosensitive body, whereby colored particles are supplied onto the photosensitive body from two directions.

At this time, since only one core is driven in rotation, it is possible to solve the problem that two cores are separately driven in rotation as conventionally to give rise to vibration due to magnetic field interference between the magnetic poles.

Preferably, rotation of the core for one of the plurality of developing rollers follows rotation of the core for another one of the plurality of developing rollers.

In the electro-photographic apparatus as above constituted, one core is driven in rotation, and the other core is freely rotated by following the rotation of the one core, whereby a balance point with the least force applied due to magnetic field interference is automatically generated to prevent the periodical vibration from occurring. Preferably, the core for one of the plurality of developing rollers is fixed.

In the electro-photographic apparatus as above constituted, the sleeve is rotated with the core for one developing unit fixed to make the sleeve rotating method, whereby the fixed magnetic poles exist in the developing area opposed to the photosensitive body to exert a strong magnetic force at anytime. Therefore, the carrier is attracted and not splashed, and the toner is not splashed to cause fogging on the background portion.

Also, the rotating sleeve cleans the carrier attached onto the photosensitive body or the toner of fogging on the background portion.

Preferably, the fixed core is fixed via a damper.

In the electro-photographic apparatus as above constituted, since the core for the developing roller is fixed, there is the fear that the vibration occurs due to magnetic field interference of the core for the opposed developing roller, but since the core is fixed via the damper, an abrupt change in the torque is prevented by absorbing the rotation of the fixed core along with the rotation of opposed core.

The invention also provides an electro-photographic apparatus, which includes a photosensitive body, a charger for charging a surface of the photosensitive body, an exposing unit for exposing the surface of the photosensitive body charged by the charger to form an electrostatic latent image having different potential levels of at least two values on the surface of the photosensitive body, a developing unit for forming a visible image on the photosensitive body by supplying colored particles to the surface of the photosensitive body, and a transfer unit for transferring the visible image onto a recording medium. The developing unit includes first and second developing rollers each having a core and a sleeve. The sleeve accommodates the core. The core has magnetic poles. The cores of the first and second developing rollers have the same arrangement of the magnetic poles. The magnetic pole of the core of one of the first and second developing rollers is placed at an opposing position where first and second developing rollers mutually oppose, while the core of the other one of the first and second developing rollers is disposed such that an intermediate portion between the magnetic poles thereof is placed at the opposing position. The sleeve of the first developing roller is driven to rotate in the same direction as a moving direction of the surface of the photosensitive body. The sleeve of the second developing roller is driven to rotate in an opposite direction to the moving direction of the surface of the photosensitive body.

In the electro-photographic apparatus as above constituted, one sleeve is rotated to move in the same direction as the moving direction of the surface of photosensitive body, and the other sleeve is rotated to move in the opposite direction to the moving direction of the surface of photosensitive body, whereby the colored particles can be supplied onto the photosensitive body from two directions, and surely attached to the edge portion of the latent image formed on the surface of photosensitive body.

In the rotation of two cores having the same arrangement of magnetic poles, the magnetic pole of one core is placed between the magnetic poles of the other core, so that a constant magnetic force is applied on both the developing rollers to prevent vibration from occurring.

DETAILED DESCRIPTION OF THE PREFERRED EMBODIMENTS

The First Preferred Embodiment

First preferred embodiments of the present invention will be described below in detail with reference to the accompanying drawings. In the embodiments as described below, the same or like parts are designated by the common numerals throughout the drawings, and the description of those parts is simplified or omitted.

Referring to FIGS. 1 to 4, a first embodiment will be described below.

Figure 1:
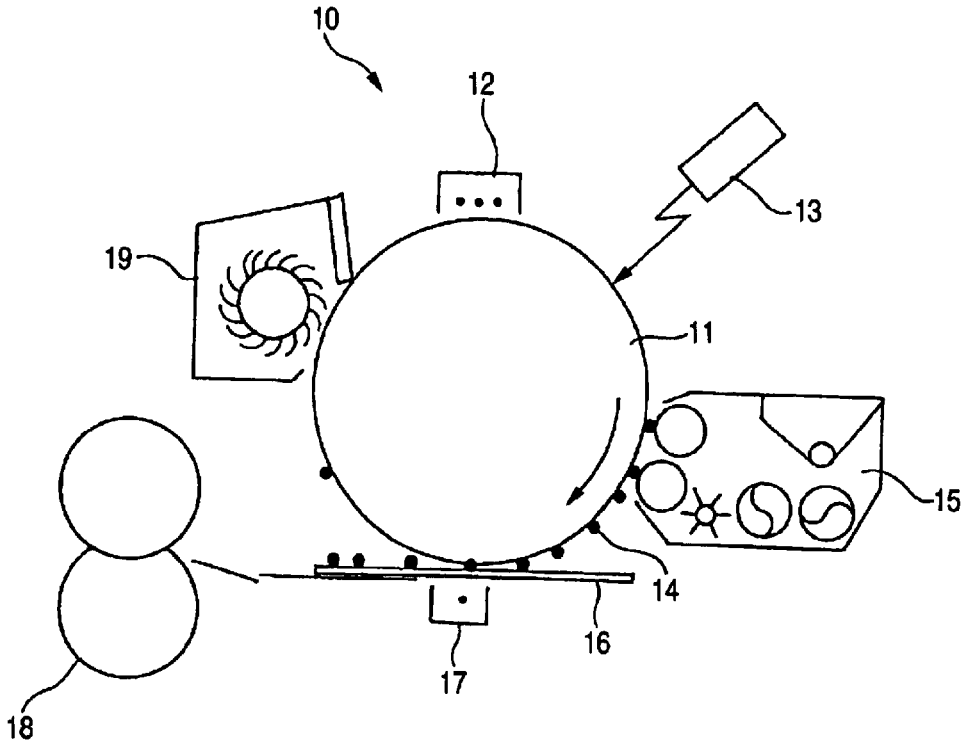
FIG. 1 is across sectional view showing a first embodiment of an electro-photographic apparatus according to the present invention.

As shown in FIG. 1, an electro-photographic apparatus 10 of the first embodiment comprises a drum-like photosensitive body 11 for forming a print image on the surface, a charger 12 for charging the surface of the photosensitive body 11, an exposing unit for exposing the surface of the photosensitive body 11 charged by the charger 12 to form an electrostatic latent image having different potential levels of at least two values on the surface of the photosensitive body 11, a developing unit 15A for developing the electrostatic latent image by attaching a toner 14 as colored particles onto the surface of the photosensitive body 11 with the electrostatic latent image carried thereon, a transfer unit 17 for transferring the toner 14 attached on the surface of the photosensitive body 11 onto the sheet 16 as a recording medium, a fixing unit 18 for fixing the toner 14 transferred onto the sheet 16, and a cleaner 19 for cleaning the surface of the photosensitive body 1 after printing.

Accordingly, the exposing unit 13 consisting of a semiconductor laser and an optical system for emitting light under the control of exposure control means such as a laser driver forms an electrostatic latent image on the surface of the photosensitive body 11 charged uniformly by the charger 12, and the developing unit 15A develops the electrostatic latent image by attaching the toner 14. The toner 14 attached on the surface of the photosensitive body 11 is transferred onto the sheet 16 by the transfer unit 17, and then heated, melted and fixed on the sheet 16 by the fixing unit 18. The toner 14 not transferred onto the sheet 16 but remaining on the surface of the photosensitive body 11 is withdrawn by the cleaner 19, whereby a series of processes are ended.

In this first embodiment, the magnetic brush bias method with two-component developer is employed as an example of the developing method, and a discharging potential is used as a latent image potential for forming the latent image on the surface of the photosensitive body 11, in which the reversing development is made.

Figure 2:
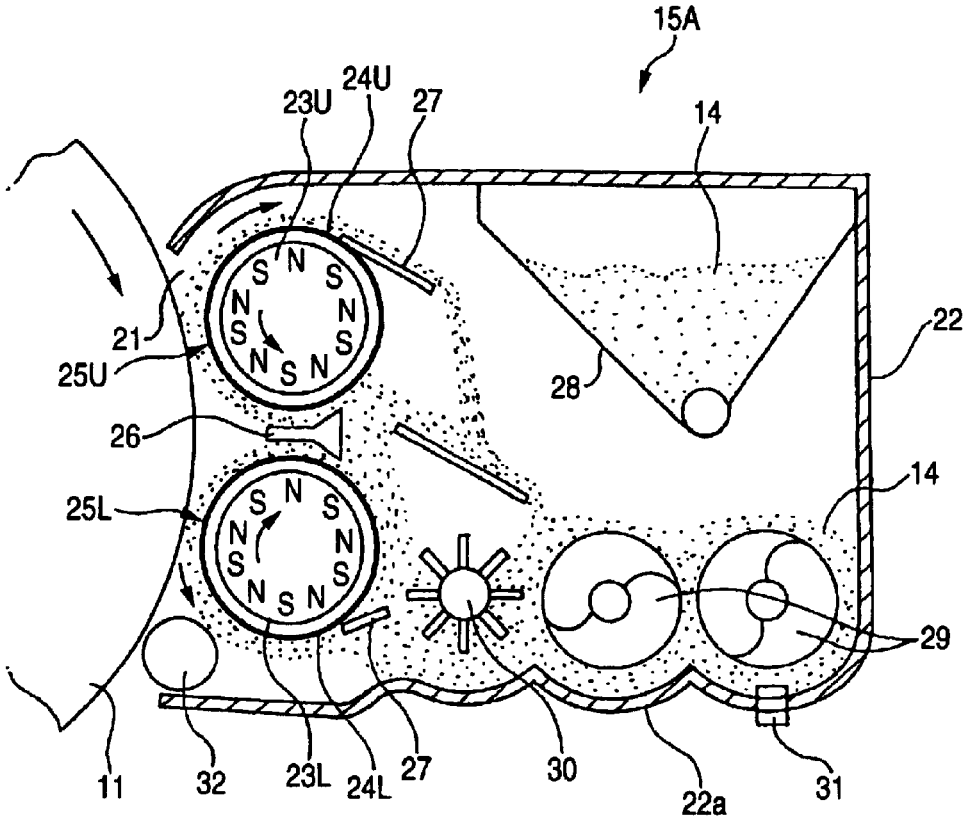
FIG. 2 is a cross sectional view showing a developing unit for the electro-photographic apparatus according to the first embodiment of the invention.

FIG. 2 shows the constitution of the developing unit 15A for use with the electro-photographic apparatus 10 according to the invention.

In this developing unit 15A, a developing unit case 22, which is shaped like a box and has a rectangular cross section, having an opening 21 on one face, is provided to cover the opening 21 with a part of the photosensitive body 11, with a slight gap.

The developing unit case 22 is provided over the entire width (width as seen in the orthogonal direction to the view of FIG. 2) of the photosensitive body 11.

As shown in FIG. 2, a plurality of (two in this case) developing rollers 25U, 25L having the cores 23U, 23L and the sleeves 24U, 24L are provided inside the developing unit case 22.

In these developing rollers 25U and 25L, at least one core 23U (23L) is rotated in counterclockwise direction in FIG. 2 so that the surface of one developing roller 25L is moved in the same direction (up to down in FIG. 2) as the moving direction of the surface of the photosensitive body 11, or is rotated in clockwise direction in FIG. 2 so that the surface of the other developing roller 25U is moved in the opposite direction (down to up in FIG. 2) as the moving direction of the surface of the photosensitive body 11.

That is, the sleeve 24U of the upper developing roller 25U is rotated in clockwise direction, and the core 23U is rotated in counterclockwise direction or stopped, while the sleeve 24L of a lower developing roller 25L is rotated in counterclockwise direction, and the core 23L is rotated in clockwise direction or stopped.

Thereby, the toner 14 is moved on the surfaces of the sleeves 24U and 24L, and supplied through an interstice between the developing rollers 25U and 25L onto the surface of the photosensitive body 11.

A doctor blade 26 for regulating the flow of the toner 14 is provided between the developing rollers 25U and 25L. A scraper 27 for scraping the toner 14 and carrier attached on the surface of the sleeve 24 for the developing roller 25U, 25L is provided behind the developing roller 25U, 25L.

A toner hopper 28 for supplying the toner 14 is provided in the rear upward inside the developing unit case 22. Beneath this toner hopper 28, a pair of auger screws 29 for agitating and equalizing the toner 14 in the width direction (orthogonal direction to the view of FIG. 2) are provided rotatably. A toner conveying roller 30 for conveying the toner 14 to the developing rollers 25U and 25L is provided between the auger screw 29 and the lower developing roller 25L.

A toner concentration sensor 31 for sensing the amount of toner 14 is mounted on a bottom face 22*a* of the developing unit toner 22, whereby the toner 14 is supplied from the toner hopper 28 in accordance with a sensing value of this toner concentration sensor 31. At the top end (left end in FIG. 2) of the bottom face 22*a* of the developing unit case 22, a carrier catch roller 32 for capturing the carrier transferred and attached from the developing unit onto the surface of the photosensitive body 11 is provided.

Figure 3:
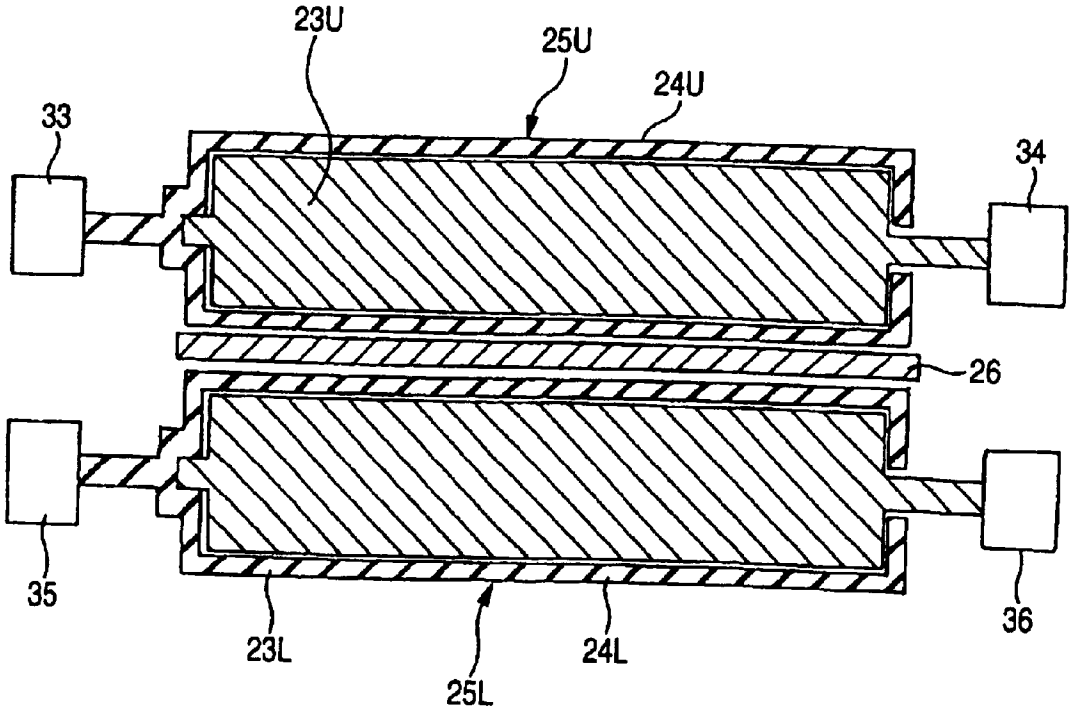
FIG. 3 is a cross sectional view showing an example of a rotating mechanism for a core, taken along the line III—III in FIG. 2.

FIG. 3 is a cross sectional view of the developing unit, taken along the line III—III in FIG. 2. The upper developing roller 25U is rotatably provided with the core 23U inside the sleeve 24U, in which the sleeve 24U can be driven in rotation by a motor 33 and the core 23U can be driven in rotation by a motor 34. The lower developing roller 25L is also rotatably provided with the core 23L inside the sleeve 24L, in which the sleeve 24L can be driven in rotation by a motor 35 and the core 23L can be driven in rotation by a motor 36.

In this manner, the toner 14 supplied from the toner hopper 28 is agitated with the carrier by one pair of auger screws 29, 29, and charged at an appropriate level. The charged toner 14 is conveyed to a back portion of the blade 26 by the toner conveying roller 30.

Thereafter, the toner 14 passes through an interstice (called a doctor gap) between the doctor blade 26 and the upper and lower developing rollers 25U, 25L, and is branched into a toner flow conveyed upward on the surface of the photosensitive body 11 by the upper developing roller 25U and a toner flow conveyed downward on the surface of the photosensitive body 11 by the lower developing roller 25L, so that the toner 14 is supplied onto the surface of the photosensitive body 11.

Therefore, the surface of the sleeve 24L for one developing roller 25L is rotated to move in the same direction as a moving direction of the surface of the photosensitive body 11, and the surface of the sleeve 24U for the other developing roller 25U is rotated to move in the opposite direction to the moving direction of the surface of the photosensitive body 11, so that the toner 14 is supplied to the photosensitive body 11 from two directions, whereby the toner 14 can be surely attached to the edge of electrostatic latent image formed on the surface of the photosensitive body 11. Thereby, the image quality can be improved by preventing the defective image edge that conventionally occurred.

Figure 4:
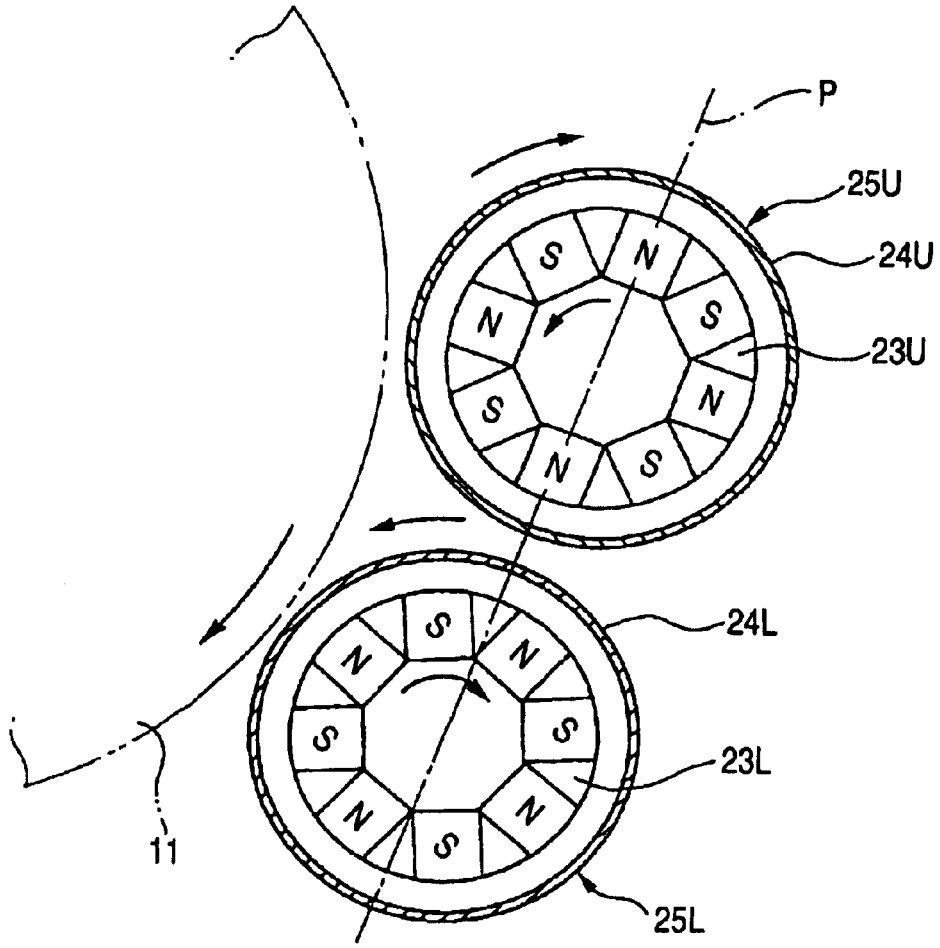
FIG. 4 is a cross sectional view showing a magnetic pole arrangement for the core.

FIG. 4 shows the arrangement of magnetic poles for the cores 23U, 23L in the upper and lower developing rollers 25U, 25L. Both the cores 23U, 23L have the same arrangement of magnetic poles, in which both the cores 23U and 23L are rotated so that the magnetic pole (N-pole here) of one core 23U is located at a position P where two developing rollers 25U, 25L are opposed, and the other core 23L is located at the position P between magnetic poles.

The cores 23U and 23L can be rotated in various ways, but may be rotated at the same rotating speed in a predetermined direction by the motors 34 and 36, as shown in FIG. 3.

Thereby, the cores 23U and 23L are rotated so that the magnetic pole of one core 23U of the cores 23U, 23L with the same arrangement of magnetic poles may be located between magnetic poles of the other core 23L, where by a constant magnetic force is applied to the developing rollers 25U and 25L to prevent the vibration from occurring.

Along with this, the jitter is prevented, whereby the high quality image can be obtained. Also, vibration due to magnetic field interference between the cores 23U and 23L can be prevented, whereby the very high quality image can be produced without disorder, jitter, the defective image edge, and the scraping of toner 14.

Figure 5:
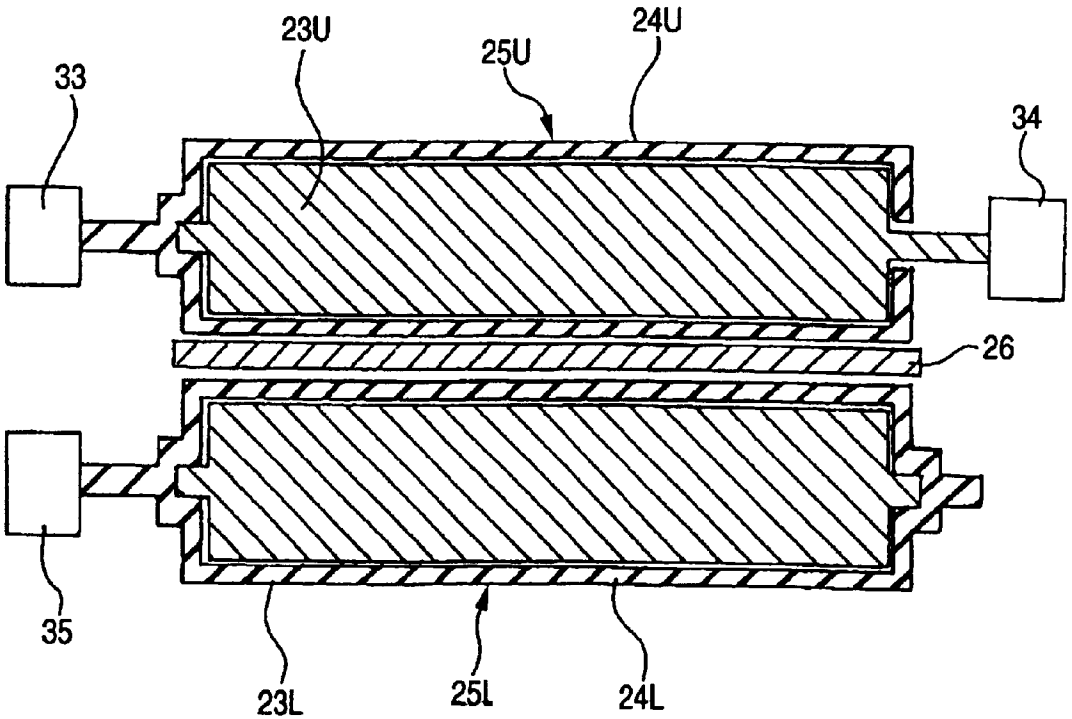
FIG. 5 is a cross sectional view showing another example of the rotating mechanism for the core.

FIG. 5 shows a second embodiment for rotating the cores 23U and 23L. In this embodiment, one core 23U is driven in rotation by the motor 34, and the other core 23L is supported to be freely rotatable, in which the arrangement of magnetic poles for the cores 23U and 23L is the same as shown in FIG. 4. In this state, if one core 23U is driven in rotation by the motor 34, one magnetic pole of one core 23U is located between the magnetic poles of the other core 23L, so that the other core 23L is dragged due to interference between the magnetic fields, and rotated as a follower at the same rotating speed in the opposite direction, as described previously and shown in FIG. 4.

Thereby, the cores 23U and 23L can take the same effect as in the first embodiment as previously described (as shown in FIG. 3) to produce the high quality image. In addition, a balance point at which the least force is applied due to a magnetic field interference is automatically generated, making it possible to avoid a manufacturing error in the arrangement of magnetic poles for the cores 23U and 23L, an adjusting error in the phase of magnetic poles, and a slight vibration caused by the rotational vibration of the cores 23U and 23L, whereby the very high quality image can be produced with less periodical vibration such as jitter.

If one core 23U is followed by the other core 23L, as above described, the balance point at which the least force is applied due to magnetic field interference is automatically generated, the arrangement of magnetic poles is not limited to that as shown in FIG. 4, but the arrangement or strength of magnetic poles for the upper and lower cores 23U and 23L maybe varied (e.g., see FIG. 6) to obtain a sufficient vibration preventing effect.

Figure 6:
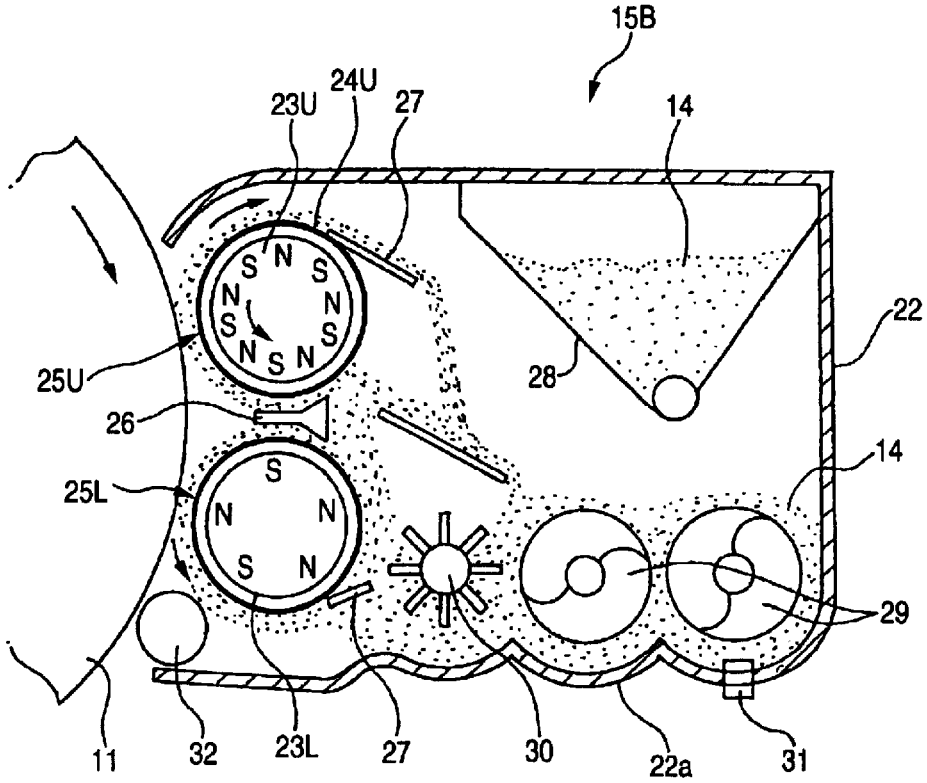
FIG. 6 is a cross sectional view showing another embodiment of the electro-photographic apparatus according to the first embodiment of the invention.
Figure 7:
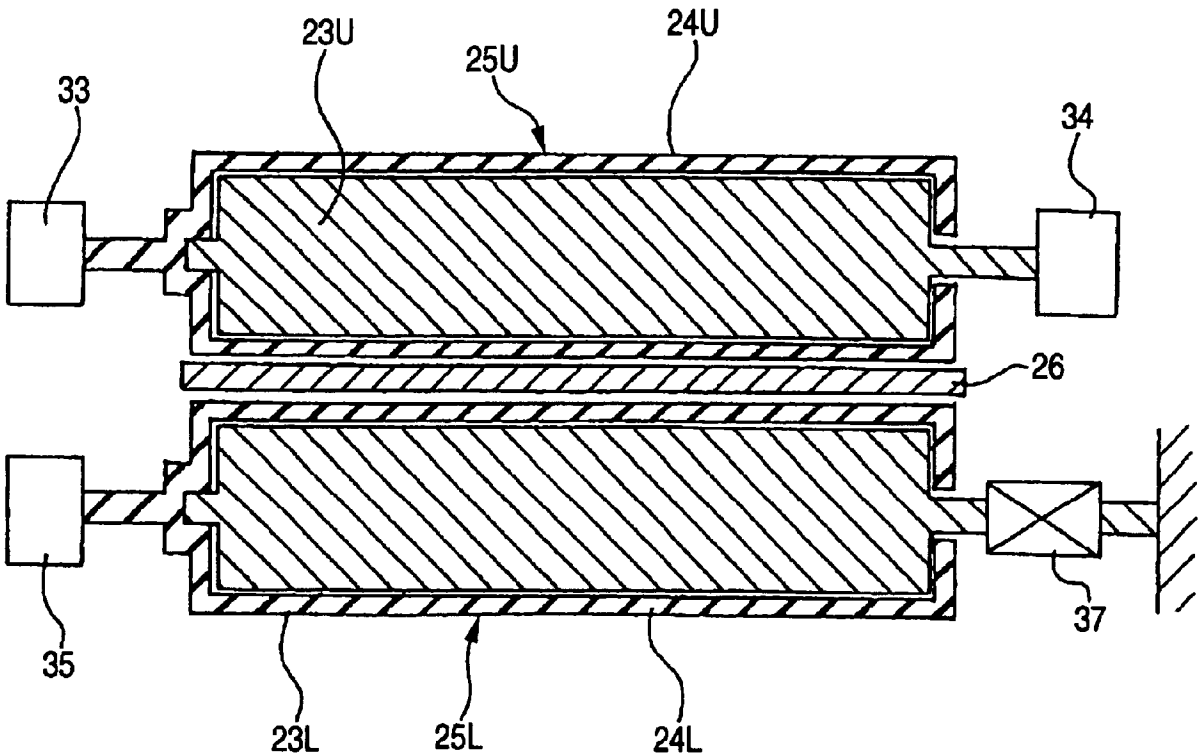
FIG. 7 is a cross sectional view showing a further example of the rotating mechanism for the core.

Referring to FIGS. 6 and 7, a third embodiment of a developing machine will be described below. FIG. 6 shows the constitution of the developing unit 15B. This developing unit 15B is the same as the developing unit 15A of FIG. 2 as previously described, except for the arrangement of magnetic poles for the lower core 23L. The same or like parts are designated by the common numerals, and the duplicate description is omitted.

FIG. 7 is a cross sectional view of the developing unit 15B, taken along the line VII—VII in FIG. 6. As shown in FIG. 7, one core (here, lower core 23L) is fixed to permit no rotation. Namely, the upper developing roller 25U relies on a core rotating method, and the lower developing roller 25L relies on a sleeve rotating method.

In the sleeve rotating method in which the core 23L is fixed, the fixed magnetic poles exist in the developing area opposed to the photosensitive body 11, so that a strong magnetic force is always applied, making it possible to suppress the carrier from splashing over the photosensitive body 11, and fogging on the background portion. Also, there is the effect of cleaning the carrier attached on the photosensitive body 11 and the toner 14 of fogging on the background.

Therefore, the upper developing roller 25U employs the core rotating method to enhance the image quality, and the lower developing roller 25L employs the sleeve rotating method, whereby the upper developing roller 25U withdraws the splashed carrier attached to the photosensitive body 11 and the fogging on the background.

Because the core 23L of the lower developing roller 25L is fixed, there is the fear that vibration occurs due to magnetic field interference of the core 23U in the upper developing roller 25U. The core 23L is fixed via the damper 37 to absorb the rotation of the core 23L caused by rotation of the core 23U to prevent an abrupt change in the torque, whereby the image quality can be improved by preventing jitter from arising on the image.

The damper 37 may be an elastic absorber such as a rubber damper to achieve the sufficient effect, but preferably employs a viscous absorber capable of absorbing vibration energy in addition to the elastic absorber to further achieve the vibration proof effect.

The developing unit and the electro-photographic apparatus of the invention are not limited to the above embodiments, but appropriate variations or improvements may be made within the scope or spirit of the present invention, regarding the core, sleeve, developing roller, damper, photosensitive body, charger, exposing unit, developing unit, and transfer unit in terms of the material, shape, size, form, number, and arrangement.

As above described, with the present invention as defined in claim 1, the sleeve for at least one developing roller is rotated to move in the same direction as the moving direction of the surface of photosensitive body, the sleeve for at least one of other developing rollers is rotated to move in the opposite direction to the moving direction of the surface of photosensitive body, whereby colored particles can be supplied onto the photosensitive body from two directions, and surely attached to the edge portion of the latent image formed on the surface of photosensitive body. Accordingly, the image quality can be improved by preventing the defective image edge that conventionally occurred. Also, since only one core is driven in rotation, the high quality image can be produced by avoiding the vibration due to magnetic field interference between the magnetic poles which conventionally occurred when two cores were separately driven in rotation.

Also, according to the invention, the rotation of one core is followed by the rotation of another core, whereby a balance point with the least force applied due to magnetic field interference is automatically generated. Therefore, it is possible to avoid a manufacturing error in the arrangement of magnetic poles for the cores, an adjusting error in the phase of magnetic poles, and a slight vibration caused by the rotational vibration of the cores, whereby the very high quality image can be produced with less periodical vibration such as jitter.

According to the invention, the sleeve rotating method is employed with the core for one developing roller fixed, whereby the fixed magnetic poles exist in the developing area opposed to the photosensitive body to exert a strong magnetic force at any time. Therefore, it is possible to suppress the splashing of carrier to be attached on the photosensitive body, and the fogging on the background portion. Also, there is the effect of cleaning the carrier attached onto the photosensitive body or the toner of fogging on the background portion.

According to the invention, the core for the developing roller is fixed, whereby there is the fear that the vibration occurs due to magnetic field interference of the core for the opposed developing roller, but since the core is fixed via the damper, an abrupt change in the torque is prevented by absorbing the rotation of the fixed core along with the rotation of opposed core. Therefore, the image quality can be improved by preventing the jitter from occurring on the image.

According to the invention, one sleeve is rotated to move in the same direction as the moving direction of the surface of photosensitive body, and the other sleeve is rotated to move in the opposite direction to the moving direction of the surface of photosensitive body, whereby the colored articles can be supplied onto the photosensitive body from two directions, and surely attached to the edge portion of the latent image formed on the surface of photosensitive body. Also, in the rotation of two cores having the same arrangement of magnetic poles, the magnetic pole of one core is placed between the magnetic poles of the other core, so that a constant magnetic force is applied on both the developing rollers to prevent vibration from occurring. Thereby, the high quality image can be produced by preventing jitter from occurring.

Also, according to the invention, the sleeve for at least one developing roller is rotated to move in the same direction as the moving direction of the surface of photosensitive body, and the sleeve for at least one of the other developing rollers is rotated to move in the opposite direction to the moving direction of the surface of the photosensitive body, whereby colored particles can be supplied onto the photosensitive body from two directions, and surely attached to the edge portion of the latent image formed on the surface of photosensitive body. Accordingly, the image quality can be improved by preventing the defective image edge that conventionally occurred. Also, since only one core is driven in rotation, the high quality image without jitter can be produced by preventing the vibration due to magnetic field interference between the magnetic poles which conventionally occurred when two cores were separately driven in rotation.

Also, according to the invention, the rotation of one core is followed by the rotation of the other core, whereby a balance point with the least force applied due to magnetic field interference is automatically generated. Therefore, it is possible to avoid a manufacturing error in the arrangement of magnetic poles for the cores, an adjusting error in the phase of magnetic poles, and a slight vibration caused by the rotational vibration of the cores, whereby the very high quality image can be produced with less periodical vibration such as jitter.

Also, according to the invention, the sleeve rotating method is employed with the core for one developing roller fixed, whereby the fixed magnetic poles exist in the developing area opposed to the photosensitive body to exert a strong magnetic force at any time. Therefore, it is possible to suppress the splashing of carrier to be attached on the photosensitive body, and the fogging on the background portion. Also, there is the effect of cleaning the carrier attached onto the photosensitive body or the toner of fogging on the background portion.

Also, according to the invention, the core for the developing roller is fixed, whereby there is the fear that the vibration occurs due to magnetic field interference of the core for the opposed developing roller, but since the core is fixed via the damper, an abrupt change in the torque is prevented by absorbing the rotation of the fixed core along with the rotation of opposed core. Therefore, the image quality can be improved by preventing the jitter from occurring on the image.

Also, according to the invention, one sleeve is rotated to move in the same direction as the moving direction of the surface of photosensitive body, and the other sleeve is rotated to move in the opposite direction to the moving direction of the surface of photosensitive body, whereby the colored particles can be supplied onto the photosensitive body from two directions, and surely attached to the edge portion of the latent image formed on the surface of photosensitive body. Also, in the rotation of two cores having the same arrangement of magnetic poles, the magnetic pole of one core is placed between the magnetic poles of the other core, so that a constant magnetic force is applied on both the developing rollers to prevent vibration from occurring. Thereby, the high quality image can be produced by preventing jitter from occurring.

The Second Preferred Embodiment

A second preferred embodiments of the present invention will be described below with reference to the accompanying drawings.

Figure 9:
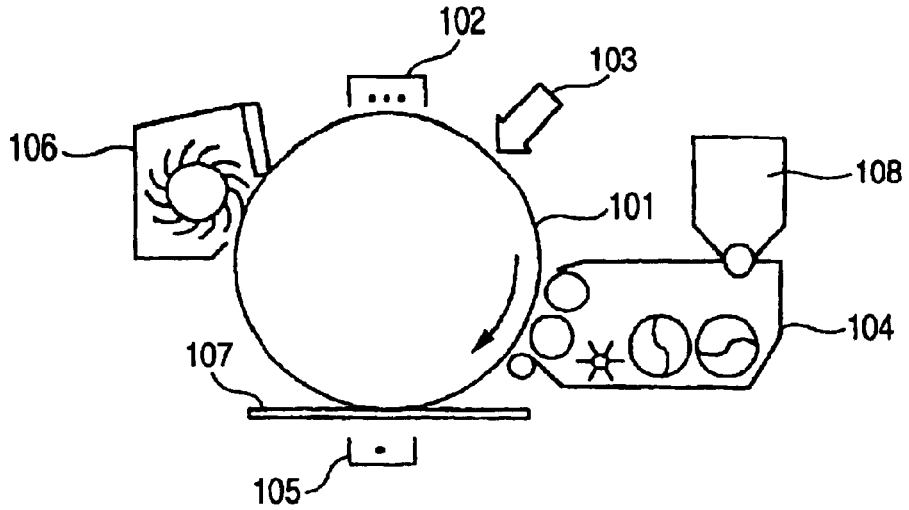
FIG. 9 is a schematic view showing the constitution of an electro-photographic printer.

Referring to FIG. 9, first of all, an image forming process of the electro-photographic printer will be described below. FIG. 9 is a typical view showing the electro-photographic printer.

A photosensitive body 101 rotated in clockwise direction has its surface uniformly charged by a charger 102, an exposing unit 103 blinks light in accordance with the image data, and an illuminated portion on the photosensitive body 101 is conductive so that a charge on the surface disappears.

A toner image is formed on the photosensitive body 101 by a developing machine 104. The toner on the photosensitive body 101 is transferred onto the sheet 107 by a transfer unit 105. The toner image transferred onto the sheet 107 is melted by heating by a fixing unit, though not shown, and fixed on the sheet 107. Thereafter, the toner remaining on the photosensitive body 101 is removed by a cleaner 106. The image formation is continued in the same way after this. The consumed toner is refilled from a toner hopper 108 by the rotation of a toner refill roll 181.

In an area where the toner is not developed on the photosensitive body 101, a slight amount of carrier may be developed. Therefore, a developing roll 143 for withdrawing the carrier is provided within the developing machine 104 or in its neighborhood.

Figure 8:
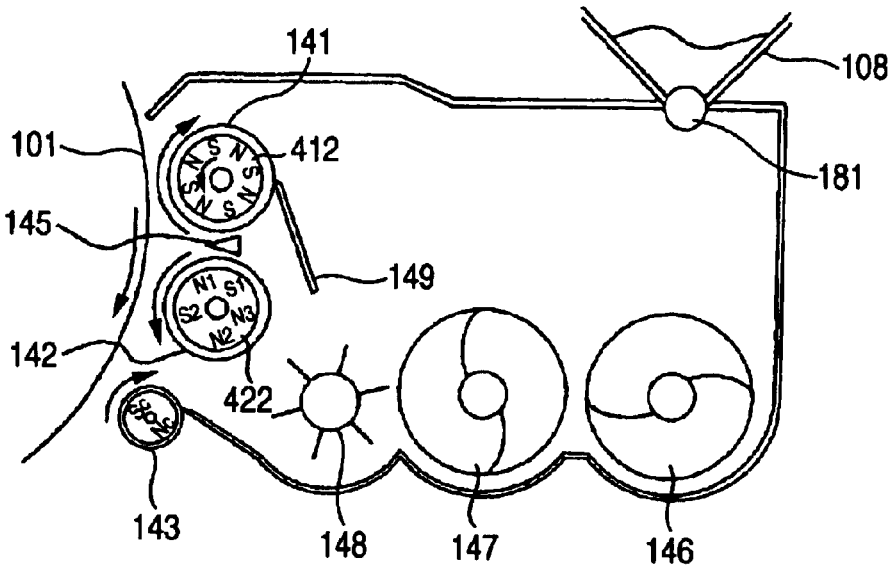
FIG. 8 is a schematic view of a developing unit according to a second embodiment of the present invention.

FIG. 8 shows the details of the constitution of the developing machine 104. The developing machine 104 has the internal constitution as shown in FIG. 8, containing a two-component developer that is a mixture of the toner and the carrier. The toner and the carrier are mixed by the rotation of the agitators 146 and 147, and charged by contact charge. Each of the developing rolls 141 and 142 has a magnetic roll internally, the developer conveyed by a paddle 148 is adsorbed onto the surface of sleeve by a magnetic force, and conveyed along with the rotation of the sleeve. The conveyed developer is regulated in amount through a gap between a doctor blade 145 and the developing roll 141, 142 in passing by the doctor blade 145. The developer having passed by the doctor blade 145 is conveyed to a developing area that is a gap portion between the photosensitive body 101 and the developing roll 141, 142, and the toner is developed on the surface of the photosensitive body 101 by the amount in accordance with a bias voltage applied to the developing roll 141, 142, a photosensitive surface potential, and a strength of electric field determined by a development gap that is a gap between the photosensitive body 101 and the developing roll 141, 142.

A developing roll 141 is a double rotation developing roll in which an internal magnet roll 412 is also rotated. The rotation direction is indicated by the arrow. Furthermore, a developing roll 142 is a sleeve rotation developing roll in which a magnet roll 422 is fixed. The magnet roll 412 of the developing roll 141 magnetically interferes with the magnet roll 422 of the developing roll 142. Specifically, they attract or repel magnetically. For example, a magnetic pole N1 of the developing roll 142 repels the N pole of the developing roll 141, and attracts the S pole. Because the magnet roll 412 of the developing roll 141 is being rotated, repulsion and attraction alternately occur, resulting in variations in the rotational torque of the magnet roll 412. The variations in the rotation torque are those in the kinetic moment around the central axis, generating vibration in a rotational direction around the rotation axis. In this case, the developing unit is vibrated. Also, since a motive power for the rotation is generated by a motor, variations in the rotation torque have effect on the motor to cause vibrations of the motor in the rotation direction. Those variations have effect on the travel speed of the sheet 107 and the exposing unit 103, giving rise to striped unevenness in a direction perpendicular to a feed direction of the sheet 107 on the print image.

Specifically, the circumferential speed of the photosensitive body 101 is 200 mm/s, and the magnet roll 412 of the developing roll 141 has eight poles and a rotating speed of 20 rps, the frequency of magnetic attraction and repulsion is equal to 8 poles ÷2×20=80 Hz, so that striped unevenness appeared on the print image at a spatial period of 200÷80=2.5 mm, where "÷" denotes a division sign and "×" denotes a multiple sign. (These signs hereinafter denote the same meanings.)

An example of means for reducing magnetic interference will be described below.

If the magnet roll 412 of the developing roll 141 and the magnet roll 422 of the developing roll 142 have the almost same diameter, and the magnetic pole angle between N1 pole and S1 pole for the magnet roll 422 and the magnetic pole angle between N pole and S pole for the magnet roll 412 are roughly equal, repulsion and attraction are emphasized depending on the rotational position of the magnet roll 412 of the developing roll 141.

For example, when the N pole and S pole of the rotatable magnetic roll 412 comes closer to the magnetic poles N1 and S1 of the non-rotatable magnet roll 422, the N1 pole and the N pole are repelled, and the S1 pole and the S pole are repelled, resulting in a greater effect in a direction to suppress the rotation of the magnet roll 412. On the other hand, when the magnet roll 412 is rotated, and the S pole and the N pole of the rotatable magnet roll 412 comes closer to the N1 pole and the S1 pole of the magnet roll 422, the N1 pole and the S pole are attracted, and the S1 pole and the N pole are attracted, resulting in a greater effect in a direction to promote rotation of the magnet roll 412. In this manner, when two magnetic poles of N pole and S pole of the rotatable magnet roll 412 and two magnetic poles of N pole and S pole of the non-rotatable magnet roll 422 come closer to each other, repulsion or attraction occurs at the same time, resulting in greater variations in the rotation torque.

Thus, in this invention, the angle or distance between magnetic poles of the rotatable magnet roll was made smaller than the angle or distance between magnetic poles of the non-rotatable magnet roll so that two magnetic poles of N pole and S pole of the rotatable magnet roll and two magnetic poles of N pole and S pole of the non-rotatable magnet roll 422 might not come closer to each other. Thereby, two magnetic poles of each magnet roll did not interfere at the same time, so that vibration was reduced.

The angle between magnetic poles for the rotatable magnet roll is made smaller than the angle between magnetic poles for the non-rotatable magnet roll, but from the experimental results, it has been found that it is preferably three-fourth or less the angle between magnetic poles for the non-rotatable magnet roll.

Figure 10:
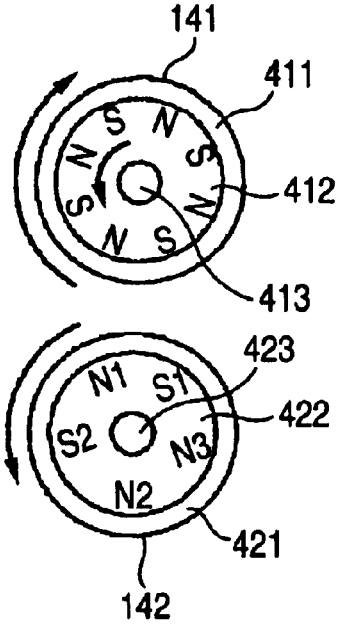
FIG. 10 is a schematic view of two developing rolls in the electro-photographic printer according to the second embodiment of the invention.
Figure 11:
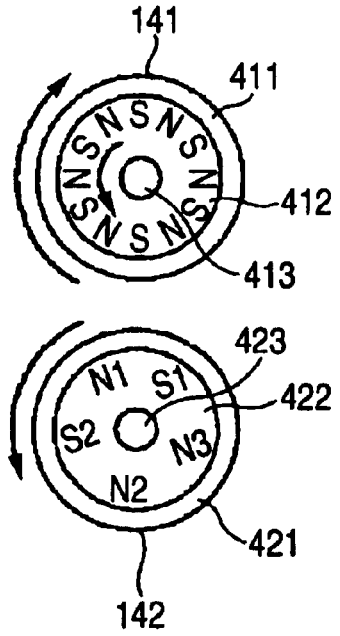
FIG. 11 is a schematic view of two developing rolls in the electro-photographic printer according to another embodiment of the second embodiment of the invention.

FIGS. 10 and 11 are typical views of the developing rolls 141 and 142 extracted to explain this invention in detail. In FIGS. 10 and 11, the developing roll 141 has the sleeve 411 and the magnet roll 412 that are rotatable, while the developing roll 141 has the rotatable sleeve 421 and the non-rotatable magnet roll 422. Reference numerals 413 and 423 denote the center of the magnet rolls 412 and 42102, respectively. The rotation direction is indicated by the arrow in the figure.

In FIG. 11, the rotatable magnet roll 412 has eight poles, so that the magnetic pole angle is 45 degrees. If the angle between pole N1 and pole S1 of the magnet roll 422 around the center of the magnet roll 422 is changed, the magnitude of vibration is changed. If the angle was increased from 45 degrees, 56 degrees to 60 degrees, the N pole and S pole of the magnet roll 412 and the N1 pole and S1 pole of the magnet roll 422 were less likely to interfere at the same time, so that vibration was reduced. Observing the influence on the print image, striped unevenness due to vibration was not seen in a case of 60 degrees. In a case of 56 degrees, appreciable striped unevenness appeared. In a case of 45 degrees, striped unevenness was easily appreciated.

In FIG. 11, the rotatable magnet roll 412 has twelve poles, so that the magnetic pole angle is 36 degrees. In the case where the angle between pole N1 and pole S1 of the magnet roll 422 is 56 degrees, striped unevenness was not seen. In a case of 45 degrees, appreciable striped unevenness appeared.

From the above results, it has been found that if the angle of magnetic poles of the rotatable magnet roll is smaller than, or preferably three-fourth or less the magnetic pole angle of the magnetic pole for the non-rotatable magnet roll closer to the rotatable magnet roll, it is possible to prevent striped unevenness from occurring.

In the example of FIG. 8, the magnetic pole angle between N pole and S pole with respect to the center of the magnet roll of the developing roll 141 is set to be three-fourth or less the magnetic pole angle between N1 pole and S1 pole with respect to the center of the magnet roll of the developing roll 142 so that interference between the magnet rolls of the developing roll 141 and the developing roll 142 may not be emphasized. In this manner, the developing machine is less subjected to vibration, so that the high definition print image can be printed without striped unevenness.

Since the positional relation between magnetic poles determines the magnetic interference, if the distance between magnetic poles of the rotatable magnet roll is smaller, or preferably three-fourth or less the distance between magnetic poles of the non-rotatable magnet roll for the magnetic pole, closer to the rotatable magnet roll, it is possible to prevent the striped unevenness from occurring. When the developing roll diameters are different, the magnetic poles may be opposed at the same location to interfere with each other even if the angles between magnetic poles are different, whereby the distance between magnetic poles is set in the condition of avoiding interference and the vibration due to interference, thereby preventing the striped unevenness from occurring.

As described above, since this invention allows the magnetic poles of the N-pole and S-pole of the rotatable magnet roll not to interfere with the magnetic poles of N-pole and S-pole of the non-rotatable magnet roll at the same time, the high definition image can be printed with the developing unit having the developing rolls composed of the sleeve and the magnet roll that are both rotated by reducing vibration due to interference between one magnetic pole of the rotatable magnet roll and the other magnetic pole.

What is claimed is:

1. A developing unit for developing an electrostatic latent image formed on a photosensitive body by supplying colored particles to a surface of the photosensitive body, comprising:

a plurality of developing rollers each having a core and a sleeve, the sleeve accommodating the core;

wherein the plurality of developing rollers includes a first developing roller and a second developing roller;

the sleeve for the first developing roller is rotated to move in the same direction as a moving direction of the surface of the photosensitive body;

the sleeve for the second developing roller is rotated to move in an opposite direction to the moving direction of the surface of the photosensitive body;

the core for at least one of the plurality of developing rollers is driven in rotation; and the core for another of the plurality of developing rollers is fixed.

2. The developing unit according to claim 1, wherein the fixed core is fixed via a damper.

3. The developing unit of claim 1, wherein developing unit supplies colored particles to a surface of the photosensitive body.

4. The developing unit of claim 1, wherein the core of another of the plurality of developing rollers is fixed with an elastic absorber.

5. The developing unit of claim 4, wherein the elastic absorber comprises a rubber damper.

6. The developing unit of claim 4, wherein the core of another of the plurality of developing rollers is further fixed with a viscous absorber.

7. A developing unit for developing an electrostatic latent image formed on a photosensitive body by supplying colored particles to a surface of the photosensitive body, comprising:

first and second developing rollers each having a core and a sleeve, the sleeve accommodating the core, the core having magnetic poles;

wherein the cores of the first and second developing rollers have the same arrangement of the magnetic poles;

the magnetic pole of the core of one of the first and second developing rollers is placed at an opposing position where first and second developing rollers mutually oppose, while the core of the other one of the first and second developing rollers is disposed such that an intermediate portion between the magnetic poles thereof is placed at the opposing position;

the sleeve of the first developing roller is driven to rotate in the same direction as a moving direction of the surface of the photosensitive body; and the sleeve of the second developing roller is driven to rotate in an opposite direction to the moving direction of the surface of the photosensitive body.

8. An electro-photographic apparatus comprising:

a photosensitive body;

a charger for charging a surface of the photosensitive body;

an exposing unit for exposing the surface of the photosensitive body charged by the charger to form an electrostatic latent image having different potential levels of at least two values on the surface of the photosensitive body;

a developing unit for forming a visible image on the photosensitive body by supplying colored particles to the surface of the photosensitive body; and a transfer unit for transferring the visible image onto a recording medium;

wherein the developing unit comprises a plurality of developing rollers each having a core and a sleeve, the sleeve accommodating the core;

the plurality of developing rollers includes a first developing roller and a second developing roller;

the sleeve for the first developing roller is rotated to move in the same direction as a moving direction of the surface of the photosensitive body;

the sleeve for the second developing roller is rotated to move in an opposite direction to the moving direction of the surface of the photosensitive body; and the core for at least one of the plurality of developing rollers is driven in rotation; and the core for another of the plurality of developing rollers is fixed.

9. The electro-photographic apparatus according to claim 8, wherein the fixed core is fixed via a damper.

10. The electro-photographic apparatus of claim 8, wherein developing unit supplies colored particles to a surface of the photosensitive body.

11. The electro-photographic apparatus of claim 8, wherein the core for another of the plurality of developing rollers is fixed with an elastic absorber.

12. The electro-photographic apparatus of claim 11, wherein the elastic absorber comprises a rubber damper.

13. The electro-photographic apparatus of claim 11, wherein the core for another of the plurality of developing rollers is further fixed with a viscous damper.

14. An electro-photographic apparatus, comprising: a photosensitive body;

a charger for charging a surface of the photosensitive body;

an exposing wilt for exposing the surface of the photosensitive body charged by the charger to form an electrostatic latent image having different potential levels of at least two values on the surface of the photosensitive body;

a developing unit for forming a visible image on the photosensitive body by supplying colored particles to the surface of the photosensitive body; and a transfer unit for transferring the visible image onto a recording medium;

wherein the developing unit comprises first and second developing rollers each having a core and a sleeve, the sleeve accommodating the core, the core having magnetic poles;

the cores of the first and second developing rollers have the same arrangement of the magnetic poles;

the magnetic pole of the core of one of the first and second developing rollers is placed at an opposing position where first and second developing rollers mutually oppose, while the core of the other one of the first and second developing rollers is disposed such that an intermediate portion between the magnetic poles thereof is placed at the opposing position;

the sleeve of the first developing roller is driven to rotate in the same direction as a moving direction of the surface of the photosensitive body; and the sleeve of the second developing roller is driven to rotate in an opposite direction to the moving direction of the surface of the photosensitive body.

15. An electro-photographic printer for forming an image, comprising:

a developing unit having a plurality of developing rolls, each having a cylindrical sleeve and a magnet roll, the magnet roll being disposed inside the sleeve;

wherein the plurality of developing rolls include a double rotation developing roll and a sleeve rotation developing roll, the sleeve rotation developing roll being disposed in proximity of the double rotation developing roll;

both of the sleeve and the magnet roll of the double rotation developing roll are rotatable;

the sleeve of the sleeve rotation developing roll is rotatable while the magnet roll of the sleeve rotation developing roll is fixed;

a first angle between magnetic poles of the magnet roll of the double rotation developing roll as seen from the center thereof is smaller than a second angle between predetermined magnetic poles of the magnet roll of the sleeve rotation developing roll as seen from the center thereof; and the predetermined magnetic poles are arranged closer to the double rotation developing roll than the other magnetic poles of the magnet roll of the sleeve rotation developing roll.

16. The electro-photographic printer according to claim 15, wherein the first angle is three-fourth or less of the second angle.

17. An electro-photographic printer for forming an image, comprising:

a developing unit having a plurality of developing rolls, each having a cylindrical sleeve and a magnet roll, the magnet roll being disposed inside the sleeve;

wherein the plurality of developing rolls include a double rotation developing roll and a sleeve rotation developing roll, the sleeve rotation developing roll being disposed in proximity of the double rotation developing roll;

both of the sleeve and the magnet roll of the double rotation developing roll are rotatable;

the sleeve of the sleeve rotation developing roll is rotatable while the magnet roll of the sleeve rotation developing roll is fixed;

a first distance between magnetic poles on a magnet roll surface of the double rotation developing roll is smaller than a second distance between predetermined magnetic poles on a magnet roll surface of the sleeve rotation developing roll; and the predetermined magnetic poles are arranged closer to the double rotation developing roll than the other magnetic poles of the magnet roll of the sleeve rotation developing roll.

18. The electro-photographic printer according to claim 17, wherein the first distance is three-fourth or less of the second distance.

19. A developing unit for developing an electrostatic latent image on a photosensitive body, comprising:

a plurality of developing rollers each having a core and a sleeve, wherein a sleeve of a first of the plurality of developing rollers rotates in the same direction as a surface of a photosensitive body, wherein a sleeve of a second of the plurality of developing rollers rotates in an opposite direction to the surface of the photosensitive body, wherein the core for one of the plurality of developing rollers rotates and the core for another of the plurality of developing rollers is fixed.

* * * * *